US006346026B1

(12) United States Patent
Chen

(10) Patent No.: US 6,346,026 B1
(45) Date of Patent: Feb. 12, 2002

(54) ORNAMENTAL DISPLAY TOY

(76) Inventor: Corrina Chen, 3F-2, No. 302, Yung Chi Road, Taipei (TW)

( * ) Notice: Subject to any disclaimer, the term of this patent is extended or adjusted under 35 U.S.C. 154(b) by 0 days.

(21) Appl. No.: 09/727,573

(22) Filed: Nov. 30, 2000

(51) Int. Cl.[7] ..... A63H 23/08
(52) U.S. Cl. ..... 446/267; 40/409; 40/410; 84/95.1
(58) Field of Search ..... 446/267; 40/409, 40/410, 406, 411; 84/95.1, 95.2

(56) References Cited

U.S. PATENT DOCUMENTS 2,518,502 A * 8/1950 Snyder ..... 40/406
2,548,706 A * 4/1951 Corning ..... 40/649
4,771,902 A * 9/1988 Teng ..... 40/410
4,939,859 A * 7/1990 Bradt ..... 40/406
5,134,795 A * 8/1992 Wang ..... 40/411
5,442,869 A * 8/1995 McDarren et al. ..... 40/410
5,456,031 A * 10/1995 Hou ..... 40/410
5,603,994 A * 2/1997 Su ..... 40/426
5,983,541 A * 11/1999 Shih ..... 40/410
6,027,774 A * 2/2000 Fine et al. ..... 40/410
6,036,571 A * 3/2000 Chang ..... 40/410

* cited by examiner

*Primary Examiner*—Jacob K. Ackun, Jr.
*Assistant Examiner*—Urszula M. Cegielnik
(74) *Attorney, Agent, or Firm*—Pro-Techtor International Services

(57) ABSTRACT

An ornamental display toy includes a hollow base, a transparent spherical shell supported on the base, the shell having a bottom opening sealed with a rubber gasket, a liquid filled in the shell before sealing of the rubber gasket, a transparent case interference-fit into a hole on the rubber gasket and suspended in the liquid in the shell, a clock holder inserted into the transparent case from the bottom side and secured thereto by a hook joint, an ornament covered on the transparent base leaving the clock of the clock holder visible from the outside of the ornamental display toy, a stepped socket mounted in the hollow base, a bushing covered with a bottom cover and detachably fastened to the inside of the stepped socket, and a musical box mounted on the bottom cover inside the bushing.

3 Claims, 8 Drawing Sheets

ORNAMENTAL DISPLAY TOY

BACKGROUND OF THE INVENTION

The present invention relates to an ornamental display toy and, more particularly, to such an ornamental display toy, which is combined with a desk clock.

FIG. 1 shows a regular crystal ball-like ornamental display toy. This structure of ornamental display toy 10 comprises a hollow base 15, a transparent spherical shell 13 supported on the hollow base 15, the transparent spherical shell 13 having a bottom opening 14 sealed with a gasket 12, a transparent liquid 16 filled in the transparent spherical shell 13 before sealing of the gasket 12, an ornament 11 mounted on the gasket 12 and suspended in the transparent spherical shell 13, and reflector chips 17 put in the transparent liquid 16 before sealing of the gasket 12. When the user shakes the ornamental display toy 10 and then puts it on the top of a table, the reflector chips 17 float in the transparent liquid 16 and then settle to the bottom of the liquid 16, simulating the flying of snowflakes. Please also refer to FIG. 2. A musical box 18 is mounted in the hollow base 15. The musical box 18 comprises a driving mechanism (clockwork) having a center shaft 19, a handle 20 coupled to the center shaft 19, a pinned barrel 21 coupled to the driving mechanism, the pined barrel 21 having pins 22 adapted to strike a metal comb (not shown) to reproduce sound upon rotation of the pinned barrel 21. Further, a transmission mechanism may be installed and coupled between the ornament 11 and the center shaft 19/the pinned barrel 21, so that the ornament 11 is moved (rotated, reciprocated, or oscillated) upon operation of the musical box 18. Similar exemplars are seen in US Pat. Nos. 5,110,636; 5,286,535; 5,338,583.

The aforesaid conventional ornamental display toys are simply used as ornamental means for display purpose to attract people. These ornamental display toys have no practical function.

SUMMARY OF THE INVENTION

It is one object of the present invention to provide an ornamental display toy, which works as an ornamental display device as well as a desk clock.

It is another object of the present invention to provide an ornamental display toy, which is detachable.

The ornamental display toy of the present invention comprises a hollow base, a transparent spherical shell supported on the base, the shell having a bottom opening sealed with a rubber gasket, a liquid filled in the shell before sealing of the rubber gasket, a transparent case interference-fit into a hole on the rubber gasket and suspended in the liquid in the shell, a clock holder inserted into the transparent case from the bottom side and secured thereto by a hook joint, an ornament covered on the transparent base leaving the clock of the clock holder visible from the outside of the ornamental display toy, a stepped socket mounted in the hollow base, a bushing covered with a bottom cover and detachably fastened to the inside of the stepped socket, and a musical box mounted on the bottom cover inside the bushing.

DETAILED DESCRIPTION OF THE PREFERRED EMBODIMENT

Figure 1:
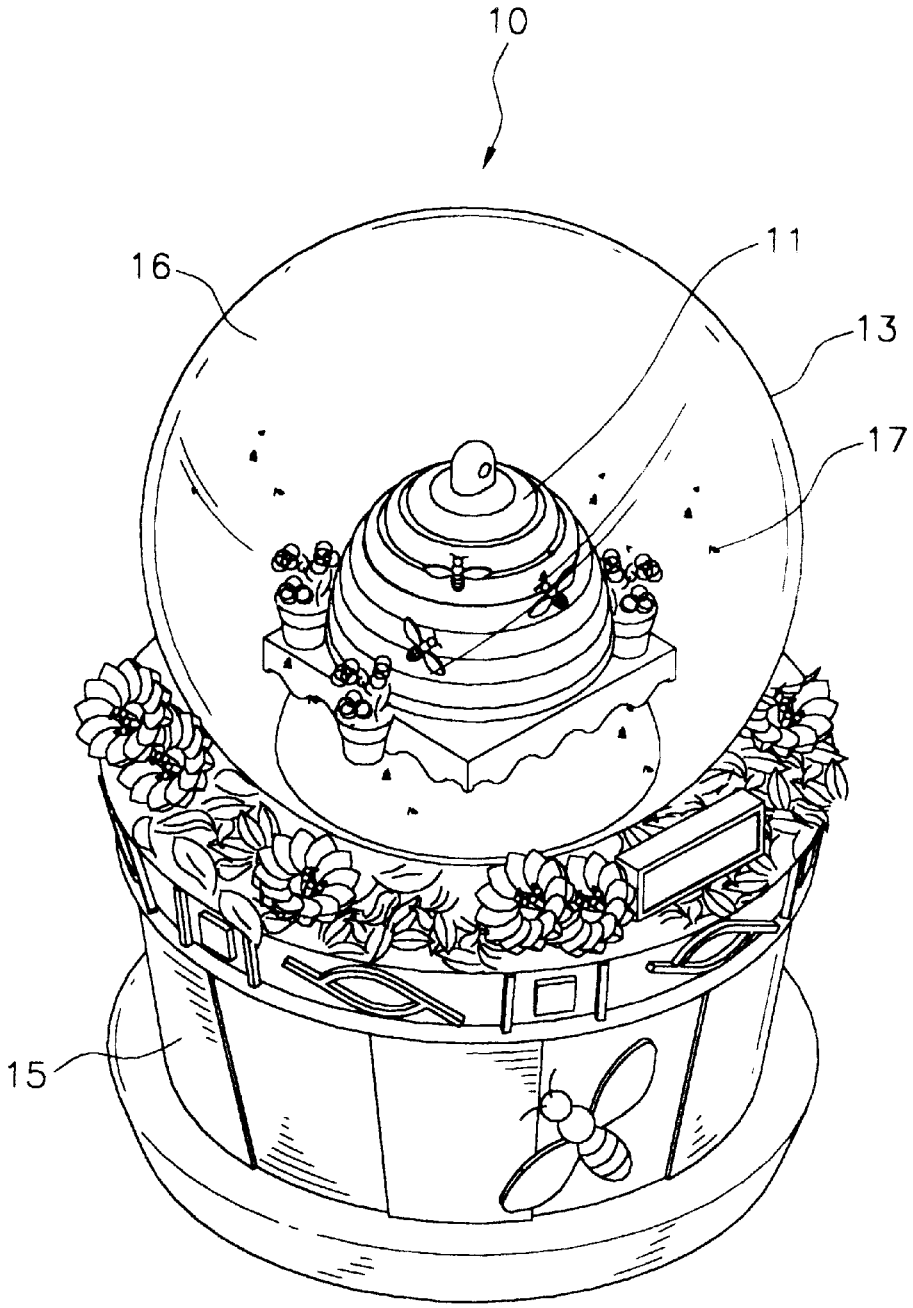
FIG. 1 (Prior Art)
FIG. 1 is a perspective view of an ornamental display toy according to the prior art.
Figure 2:
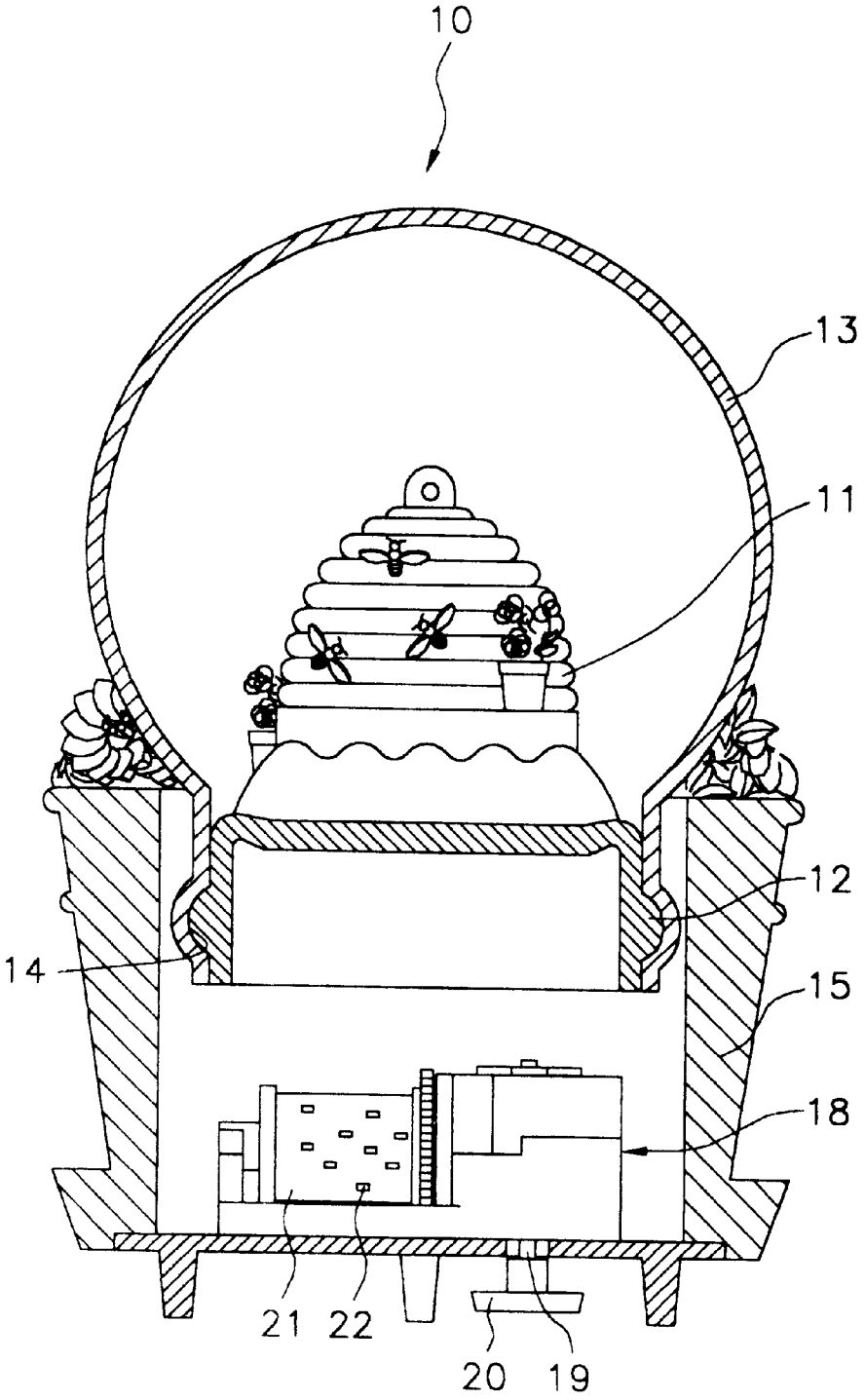
FIG. 2 (Prior Art)
FIG. 2 is a longitudinal view in section of the ornamental display toy shown in FIG. 1.
Figure 3:
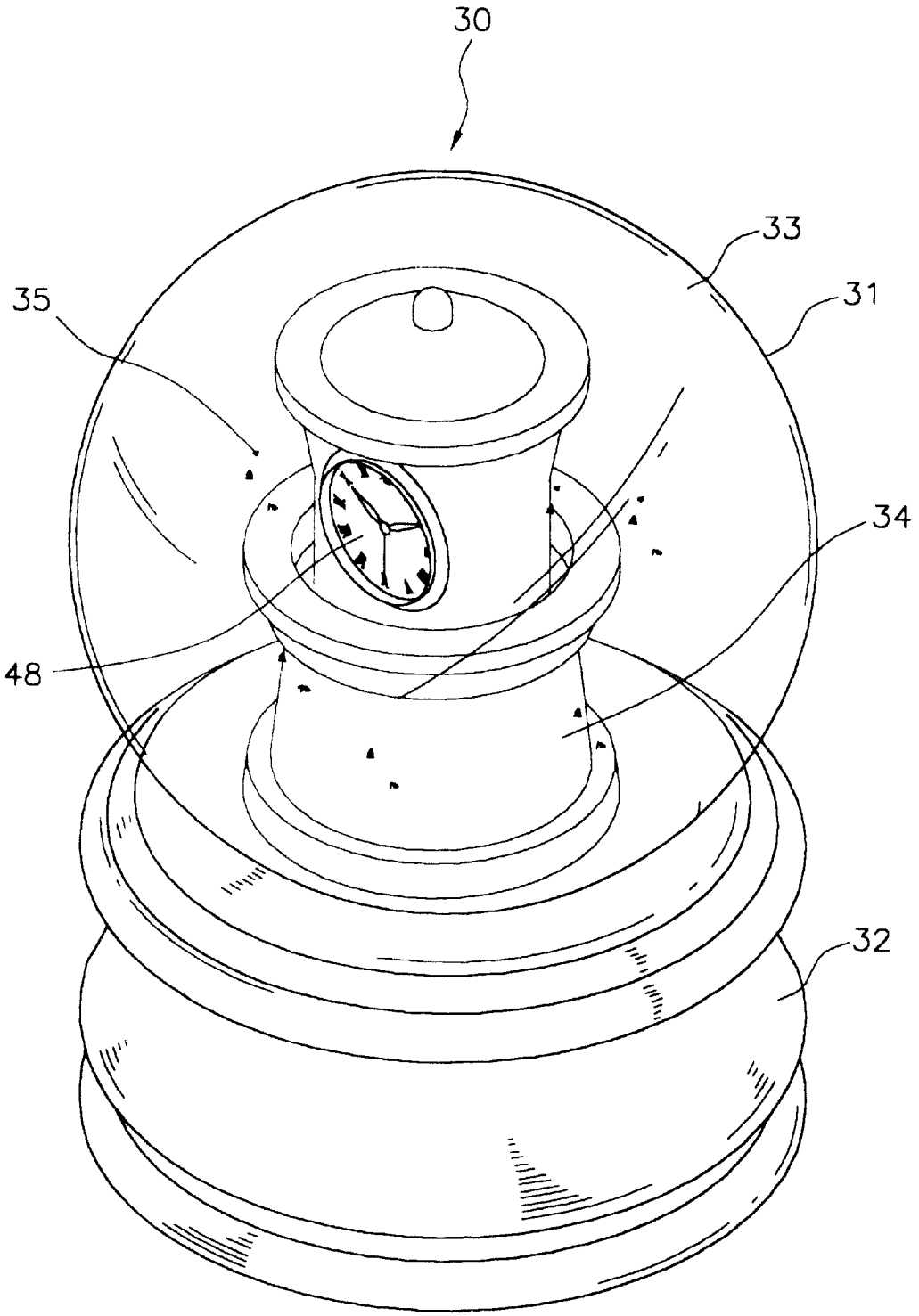
FIG. 3 is a perspective view of an ornamental display toy according to the present invention.
Figure 5:
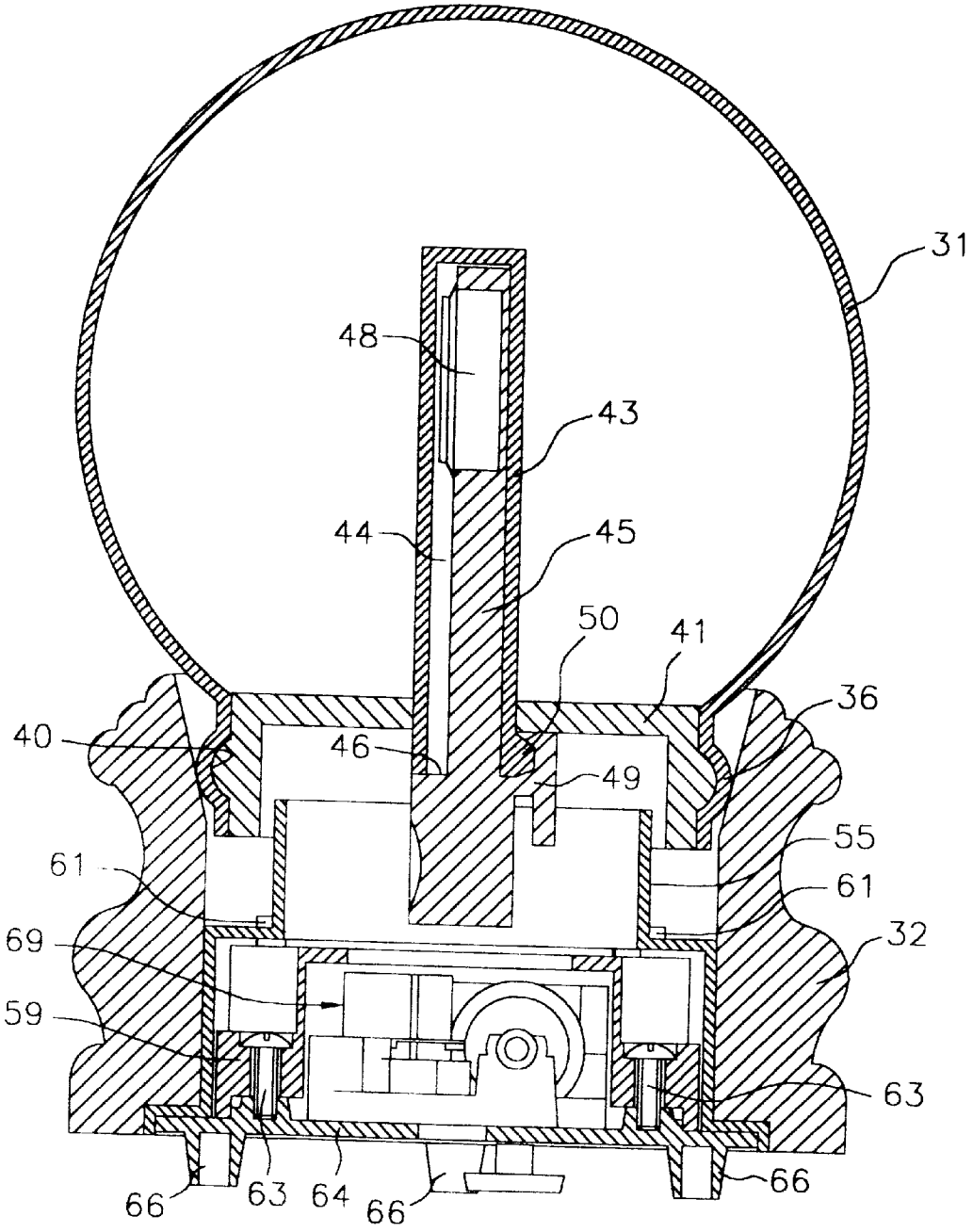
FIG. 5 is a longitudinal view in section of FIG. 4.

Referring to FIGS. 3 and 5, an ornamental display toy 30 comprises a hollow base 32, a transparent shell 31 filled up with a transparent liquid 33 and supported on the base 32, an ornament 34 dipped in the liquid 33 inside the shell 31. Further, reflector chips 35 may be put in the liquid 33 inside the shell 31, so that reflector chips 35 float in the liquid 33 and then settle to the bottom of the liquid 33 to simulate the motion of snowflakes after the ornamental display toy 30 has been shaken and then put on a flat surface, for example, the top of a table.

Figure 6:
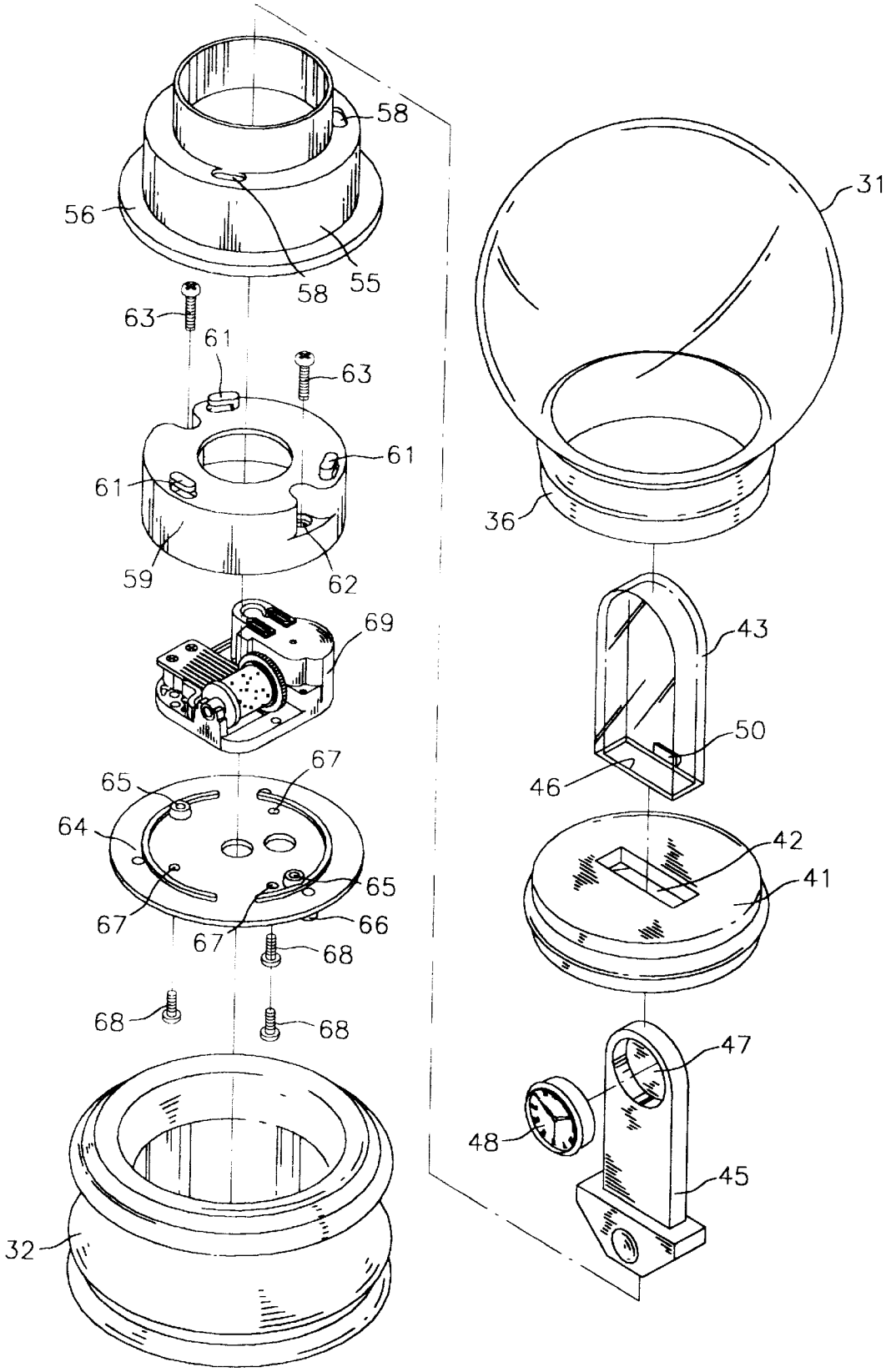
FIG. 6 is an exploded view of FIG. 5.

Referring to FIGS. 5 and 6, the shell 31 has a bottom neck 36 defining an opening 40. The liquid 33 is filled into the inside of the shell 31 through the opening 40, and then the opening 40 is sealed with a rubber gasket 41 after filling of the liquid 33. The rubber gasket 41 interference-fits the inside wall of the neck 36 to close the opening 40, and to stop the liquid 33 from leaking out of the shell 31.

Figure 4:
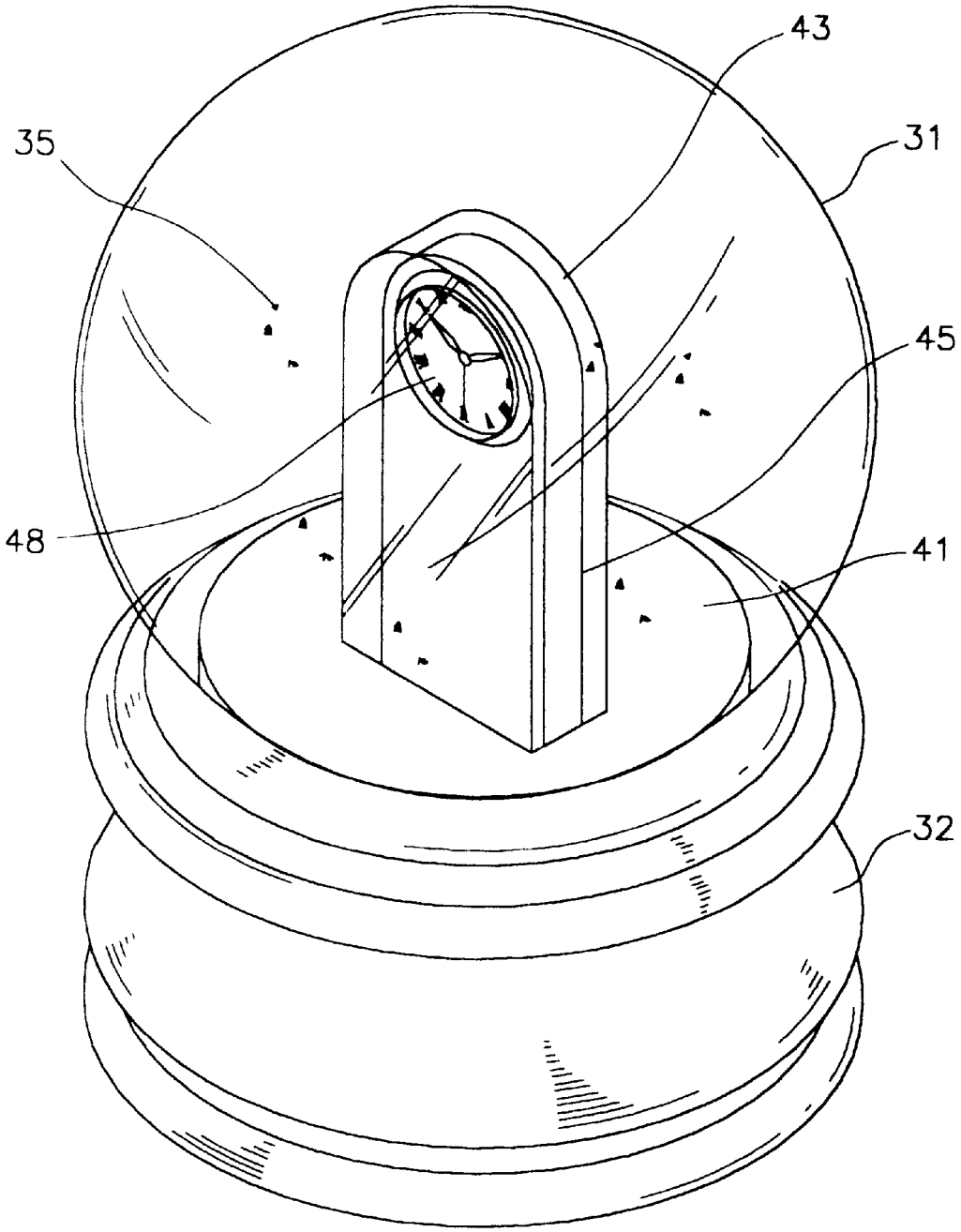
FIG. 4 is another perspective view of the present invention before mounting of the ornament on the transparent case.
Figure 8:
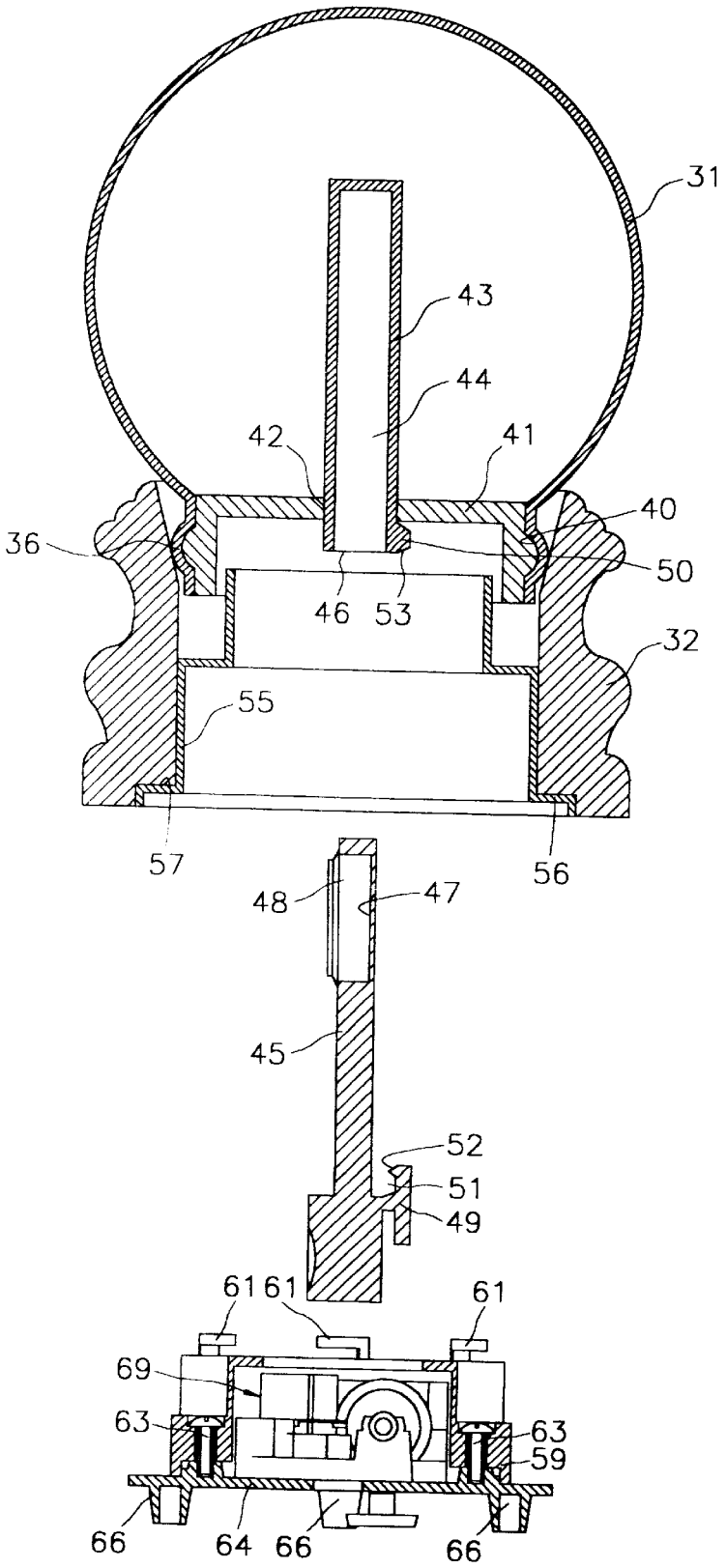
FIG. 8 is an exploded view in section of the present invention, showing the clock holder removed from the transparent case, the bushing, the musical box and the bottom cover fastened together and removed from the stepped socket.

Referring to FIGS. 4 and 8 and FIGS. 5 and 6 again, the rubber gasket 41 has a center through hole 42 for the installation of a case 43. The case 43 is made of transparent material, for example, transparent acrylic resin. The lower part of the case 43 interference-fits the center through hole 42 of the rubber gasket 41. After installation of the case 43 in the center through hole 42 of the rubber gasket 41, the case 43 stops the liquid 33 from passing out of the shell 31 through the center through hole 42 of the rubber gasket 41. Further, the case 43 is a bottom-open container having a bottom opening 46 and a retaining flange 50 disposed at the bottom side of the back sidewall thereof. The retaining flange 50 has a beveled bottom edge 53. A clock holder 45 is inserted through the bottom opening 46 into the inside space 44 of the case 43. The clock holder 45 comprises a recessed circular hole 47 disposed at the front side wall thereof near the top side, which holds a clock 48, and a springy hook 49 extended from the back side wall thereof near the bottom side and hooked on the retaining flange 50 of the case 43. The springy hook 49 has a beveled top edge 52 corresponding to the beveled bottom edge 53 of the retaining flange 50. When inserting the clock holder 45 through the bottom opening 46 into the inside space 44 of the case 43, the beveled top edge 52 is moved with the springy hook 49 over the beveled bottom edge 53 of the retaining flange 50, enabling the retaining flange 50 to be engaged into the retaining groove 51 defined in the springy hook 49. When pressing the forefinger and the thumb on the lower part of the springy hook 49 and the lower part of the front side wall of the clock holder 45 and then squeezing the lower part of the springy hook 49 toward the back side wall of the clock holder 45, the springy hook 49 is disengaged from the retaining flange 50, enabling the clock holder 45 to be taken out of the case 43 for a repair work or replacement of the battery of the clock 48. The aforesaid ornament 34 is formed of, for example, epoxy resin on the outside wall of the case 43. Further, the ornament 34 has an opening 54 through which the clock 48 is viewed from the outside of the ornamental display toy 30 (see FIG. 3).

Figure 7:
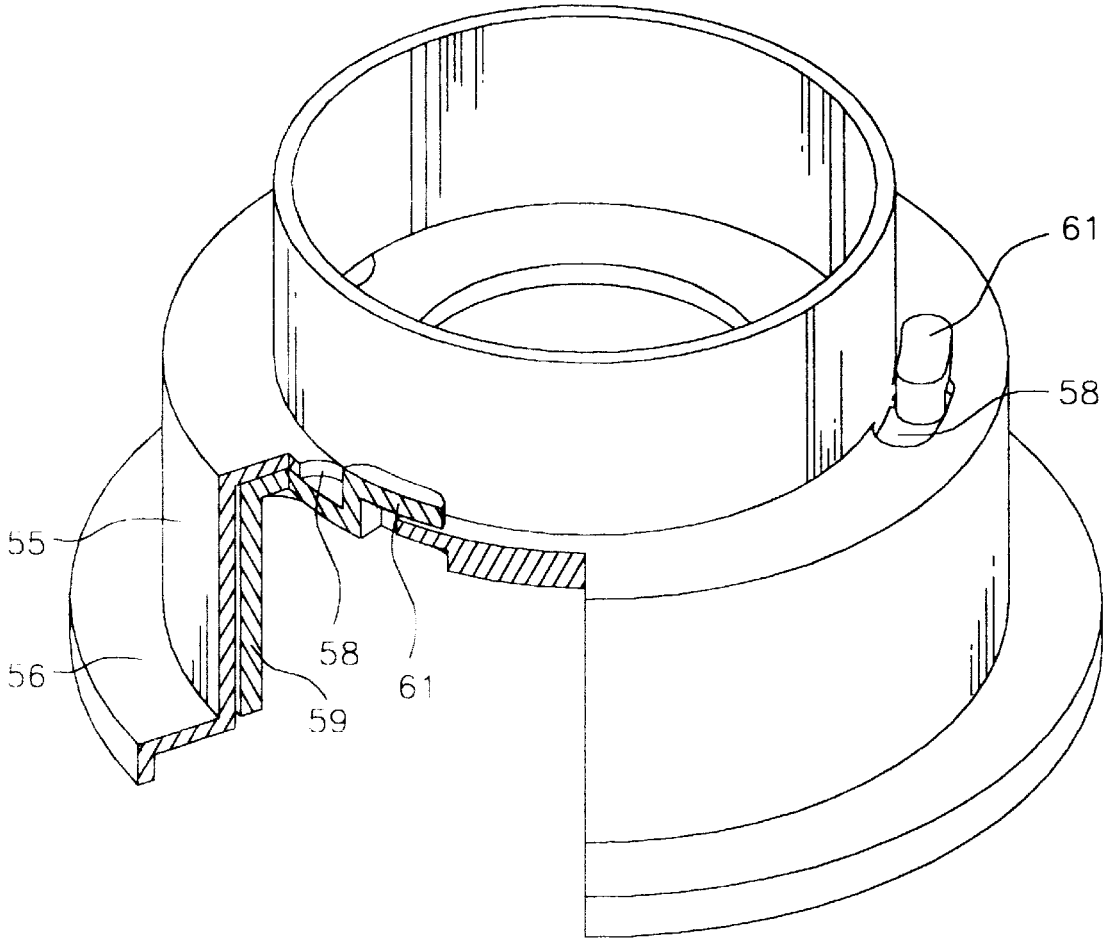
FIG. 7 is a cutaway of a part of the present invention, showing the bushing mounted inside the stepped socket.

Referring to FIG. 7 and FIGS. 5, 6 and 8 again, the ornamental display toy 30 further comprises a stepped socket 55 mounted in the base 32, a bushing 59 mounted in the stepped socket 55, a bottom cover 64 fastened to the bushing 59 and adapted to support the ornamental display toy 30 on a flat surface, and a musical box 69 mounted on the bottom cover 64 and disposed inside the bushing 59. The base 32 has a countersunk hole 57 on its bottom side. The stepped socket 55 comprises an outward bottom flange 56 fitting the bottom countersunk hole 57 of the base 32 and fixedly secured thereto with a bonding agent or by means of a suitable fixation method, and three hook holes 58 equiangularly spaced on the shoulder thereof. The bushing 59 comprises three hooks 61, which are respectively inserted into the hook holes 58 of the stepped socket 55, and then forced into engagement with the hook holes 58 upon a rotary motion of the bushing 59 relative to the stepped socket 55. When rotating the bushing 59 in the reversed direction relative to the stepped socket 55, the hooks 61 are disengaged from the hook holes 58, enabling the bushing 59 to be removed from the stepped socket 55. The bushing 59 further comprises two screw holes 62 disposed at two sides and extended in axial direction. Two screws 63 are respectively threaded into the screw holes 62 of the bushing 59 and respective female screws 65 at the bottom cover 64 to fixedly secure the bottom cover 64 to the bottom side of the bushing 59. The bottom cover 64 comprises three foot members 66 downwardly extended from the bottom sidewall thereof and respectively spaced from one another at 120°, and three equiangularly spaced screw holes 67. Screws 68 are respectively threaded into the screw holes 67 of the bottom cover 64 and respective bottom screw holes (not shown) on the musical box 69 to fixedly secure the musical box 69 to the bottom cover 64. Because the bushing 59, the bottom cover 64 and the musical box 69 are fixedly fastened together, they can be removed from the stepped socket 55 at a time. After removal of the bushing 59, the bottom cover 64 and the musical box 69 from the stepped socket 55, the clock holder 45 can then be taken out of the case 43 for a repair work or replacement of the battery of the clock 48.

It is to be understood that the drawings are designed for purposes of illustration only, and are not intended for use as a definition of the limits and scope of the invention disclosed.

What is claimed is:

1. An ornamental display toy comprising:

a hollow base, a transparent shell supported on said hollow base, said transparent shell having a bottom opening through which a liquid and reflector chips are received into said transparent shell, a gasket that seals said bottom opening of said transparent shell after said transparent shell is filled with said liquid and said reflector chips, said gasket having a through hole, a transparent case interference-fit in said through hole of said gasket and suspended in said transparent shell, said transparent case comprising a receiving chamber and a back retaining flange disposed at a bottom side of a back sidewall thereof, a clock holder mounted in said transparent case, said clock holder having an upper part inserted into said receiving chamber of said transparent case, said clock holder having a lower part disposed outside said transparent case, said clock holder having a recessed hole disposed at a front side of said upper part to receive a clock therein, and said clock holder having a retaining hook extended from a back side wall of said lower part, said retaining hook defining a retaining groove adapted to receive said retaining flange of said transparent case.

2. The ornamental display toy of claim 1 further comprising:

an ornament covered by said transparent case, said ornament having an opening through which said clock is exposed.

3. The ornamental display toy of claim 2 further comprising:

a stepped socket mounted in said hollow base, said stepped socket comprises a bottom flange fastened to a bottom side of said hollow base, a shoulder, and a plurality of hook holes positioned on said shoulder, a bushing mounted in said stepped socket, said bushing comprises a plurality of hooks positioned on a top side thereof, said hooks are received in said hook holes of said stepped socket to secure said bushing to said stepped socket, a bottom cover fastened to a bottom side of said bushing, said bottom cover comprises a plurality of foot members adapted to support said ornamental display toy on a flat surface, and a musical box mounted on said bottom cover inside said bushing.

* * * * *